US006461222B1

(12) United States Patent
Sato

(10) Patent No.: US 6,461,222 B1
(45) Date of Patent: Oct. 8, 2002

(54) PLANARIZING AND POLISHING APPARATUS AND PLANARIZING AND POLISHING METHOD

(75) Inventor: Shuzo Sato, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/539,379

(22) Filed: Mar. 31, 2000

(30) Foreign Application Priority Data

Apr. 7, 1999 (JP) ..... 11-099942

(51) Int. Cl.[7] ..... B24B 49/12; B24B 51/00

(52) U.S. Cl. ..... 451/5; 451/6; 451/41; 451/287

(58) Field of Search ..... 451/5, 6, 41, 285–288, 451/398

(56) References Cited

U.S. PATENT DOCUMENTS 5,245,794 A * 9/1993 Salugsugan ..... 451/10
5,597,341 A * 1/1997 Kodera et al. ..... 451/5
5,597,442 A * 1/1997 Chen et al. ..... 156/626.1
5,853,317 A * 12/1998 Yamamoto ..... 451/288
5,899,792 A * 5/1999 Yagi ..... 451/6
6,113,465 A * 9/2000 Kim et al. ..... 451/41
6,120,349 A * 9/2000 Nyui et al. ..... 451/21
6,213,844 B1 * 4/2001 Lenkersdorfer ..... 451/6
6,238,271 B1 * 5/2001 Cesna ..... 451/41
6,257,953 B1 * 7/2001 Gitis et al. ..... 451/5
6,293,846 B1 * 9/2001 Oguri ..... 451/6

* cited by examiner

*Primary Examiner*—Timothy V. Eley
*Assistant Examiner*—David B. Thomas
(74) *Attorney, Agent, or Firm*—Rader, Fishman & Grauer PLLC; Ronald P. Kananen, Esq.

(57) ABSTRACT

There is provided a planarizing and polishing apparatus and a planarizing and polishing method for measuring the polishing conditions of a polishing work during the polishing process in view of obtaining a fault-free polishing work. The planarizing and polishing apparatus is provided with a detecting unit for detecting a change in surface reflectivity of the polishing work and a control unit for recognizing the additional polishing part of the polishing work based on the detected value from the detecting unit and then automatically generating, for the feedback purpose, the polishing conditions of the additional polishing part and the portion other than the additional polishing part.

11 Claims, 11 Drawing Sheets

PLANARIZING AND POLISHING APPARATUS AND PLANARIZING AND POLISHING METHOD

FIELD OF THE INVENTION

The present invention relates to a planarizing and polishing-apparatus and a planarizing and polishing method for polishing flat a plated film or an insulating film formed, for example, on the surface of a wafer.

BACKGROUND OF THE INVENTION

FIGS. 1A to 1F are side elevation views of cross-sections illustrating the fabrication process of a metal interconnection type substrate. On the surface of a wafer 1 formed of silicon, an interconnection pattern 2 formed of copper (Cu) is formed and the surface of wafer 1 including interconnection pattern 2 is covered with an insulating film 3 formed of silicon dioxide (SiO2) (in FIG. 1A). A conducting hole 4 for laminated interconnection pattern is formed by etching to an insulating film 3 (in FIG. 1B), the surface of the insulating film 3 including the internal surface of the conducting hole 4 is covered with a barrier film 5 formed of tantalum (Ta) and titanium (Ti) or the like (in FIG. 1C) and a seed film 6 of copper (Cu) is formed by the sputtering method (in FIG. 1D). A rather thick laminated interconnection pattern film 7 formed of copper (Cu) is formed by the plating process in such a way as perfectly filling the inside of conductive hole 4 (in FIG. 1E). Thereafter, unwanted laminated interconnection pattern film 7 on the insulating film 3 is removed by the polishing process to form the laminated interconnection pattern 8 in order to attain the final metal interconnection type substrate (in FIG. 1F).

In the polishing process for fabricating the metal interconnection type substrate 9 explained above, a planarizing and polishing apparatus is used. FIG. 2 is a perspective view schematically illustrating the planarizing and polishing apparatus of the related art. This planarizing and polishing apparatus 20 is provided with a rotatable disk type surface plate 22 on which surface a polishing cloth 21 is stuck, a disk type mounting plate 23 which can rotate horizontally and move vertically, (in the Z direction) to hold a wafer 1 at the lower surface thereof and a nozzle 24 for supplying a kind of polishing liquid P onto the polishing cloth 21. In such a configuration, first, the surface of wafer 1 on which the laminated interconnection pattern film 7 is formed is directed downward and the rear surface of wafer 1 is then bonded or vacuum-absorbed to the lower surface of the mounting plate 23. Next, the surface plate 22 and mounting plate 23 are rotated and the polishing liquid P is supplied onto the polishing cloth 21 from the nozzle 24. Moreover, the mounting plate 23 is moved downward to press the surface of wafer 1 with the polishing cloth 21 to polish the laminated interconnection pattern film 7 formed on the surface of wafer 1.

The planarizing and polishing apparatus 20 of the related art has a disadvantage that a degree of polishing of the laminated interconnection pattern film 7 by this polishing apparatus is not constant because of time management and an accurate degree of polishing cannot be detected until the end of the polishing process. Moreover, measurement for a degree of polishing is accompanied by a disadvantage that an additional exclusive thickness measuring device is required and many processing steps are also required. In addition, here rises a problem that polishing accuracy is unstable because this polishing accuracy changes depending on the condition of polishing cloth 21; moreover, this polishing accuracy also changes depending on experience and intuition of worker Therefore, in some cases, the fault such as dishing, erosion (thinning), recess, scratch, chemical damage, over-polishing and under-polishing are generated as will be described later. FIG. 3A illustrates an example of dishing. In this fault, the center area of the wide laminated interconnection pattern film 7 is polished excessively in the shape of a dish and thereby the cross-sectional area of the laminated interconnection pattern 8 becomes insufficient. FIG. 3B illustrates an example of erosion (thinning). In this fault, the insulating film 3 is also polished excessively together with the laminated interconnection pattern film 7 having higher pattern density and thereby the cross-sectional area of the laminated interconnection pattern 8 also becomes insufficient. FIG. 3C illustrates an example of scratch and chemical damage. In this fault, an open-circuit or a short-circuit or defective resistance value of the laminated interconnection pattern 8 is generated. FIG. 3D illustrates an example of over-polishing and under-polishing. In these faults, the laminated interconnection pattern film 7 is left at the surface because the setting for a degree of polishing of the laminated interconnection pattern film 7 is insufficient and this remaining laminated interconnection pattern film 7 results in short-circuit of interconnection, or over-setting for a degree of polishing of the laminated interconnection pattern film 17 results in dishing or erosion.

OBJECT AND SUMMARY OF THE INVENTION

It is therefore an object of the present invention to provide a planarizing and polishing apparatus and method for obtaining a fault-free polishing work by measuring polishing condition of a polishing work.

According to one aspect of the present invention, the planarizing and polishing apparatus comprising a polishing means for polishing flat a surface of a polishing work through relative movement in one direction can be realized by providing A detecting means for detecting a change in surface reflectivity of the polishing work, a control means for recognizing the part to be polished further (i.e., an additional polishing part) of the polishing work based on the detection value from the detecting means, and automatically generating polishing conditions of the additional polishing part and the other portions in order to feed back such polishing conditions.

Moreover, according to an other aspect of the present invention, the planarizing and polishing method for polishing flat the surface of a polishing work through relative movement of the polishing means in one direction at the surface of polishing work can be realized by polishing the surface of the polishing work, detecting a change in surface reflectivity of the polishing work, recognizing the part, in which the detected value is higher than the predetermined value, as the additional polishing part of the polishing work, relatively moving at a high speed the polishing means at the portion other than the additional polishing part and relatively moving at a low speed the polishing means at the additional polishing part in view of polishing again the surface of the polishing work.

According to the present invention explained above, since difference of surface reflectivity due to the difference of material is utilized for detection of polishing condition, the polishing condition of the polishing work in which different materials are particularly laminated can easily be measured. Therefore, it is now possible to identify, during the polishing process, the additional polishing part of the polishing work and then conduct the centralized polishing to the additional polishing, part. Accordingly, polishing accuracy can be improved, under-polishing can be prevented and over-polishing can also be reduced.

DESCRIPTION OF THE PREFERRED EMBODIMENTS

The preferred embodiments of the present invention will be explained in detail with reference to the accompanying drawings. The embodiments to be described below are preferred embodiments of the present invention and is therefore given various preferred limitations from the technical viewpoint but the scope of the present invention is never limited thereto particularly unless otherwise description for restriction thereto of the present invention in the following explanation.

Figure 1A:
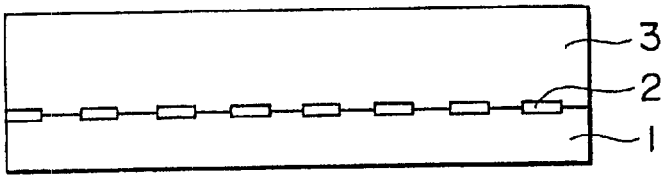
PRIOR ART FIG.1A
FIGS. 1A to 1F are side elevation views of cross-sections illustrating a fabrication process of a metal interconnection type substrate.
Figure 1B:
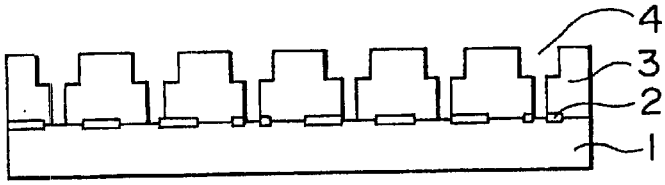
Figure 1C:
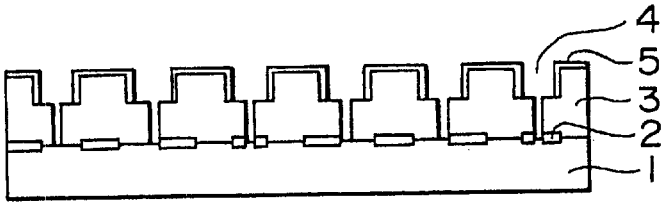
Figure 1D:
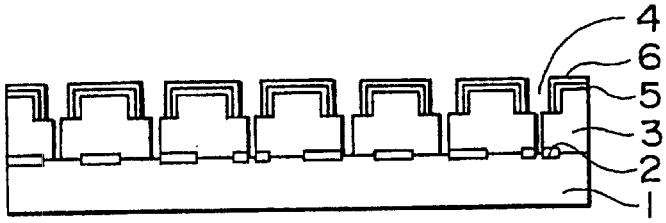
Figure 1E:
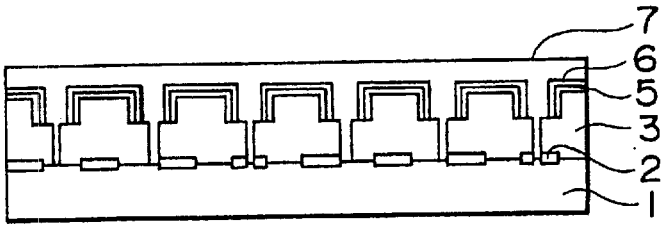
Figure 1F:
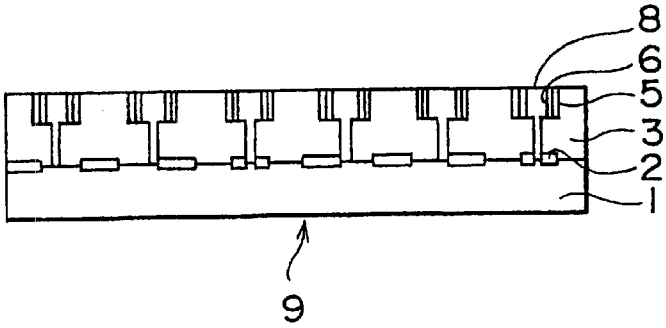
Figure 2:
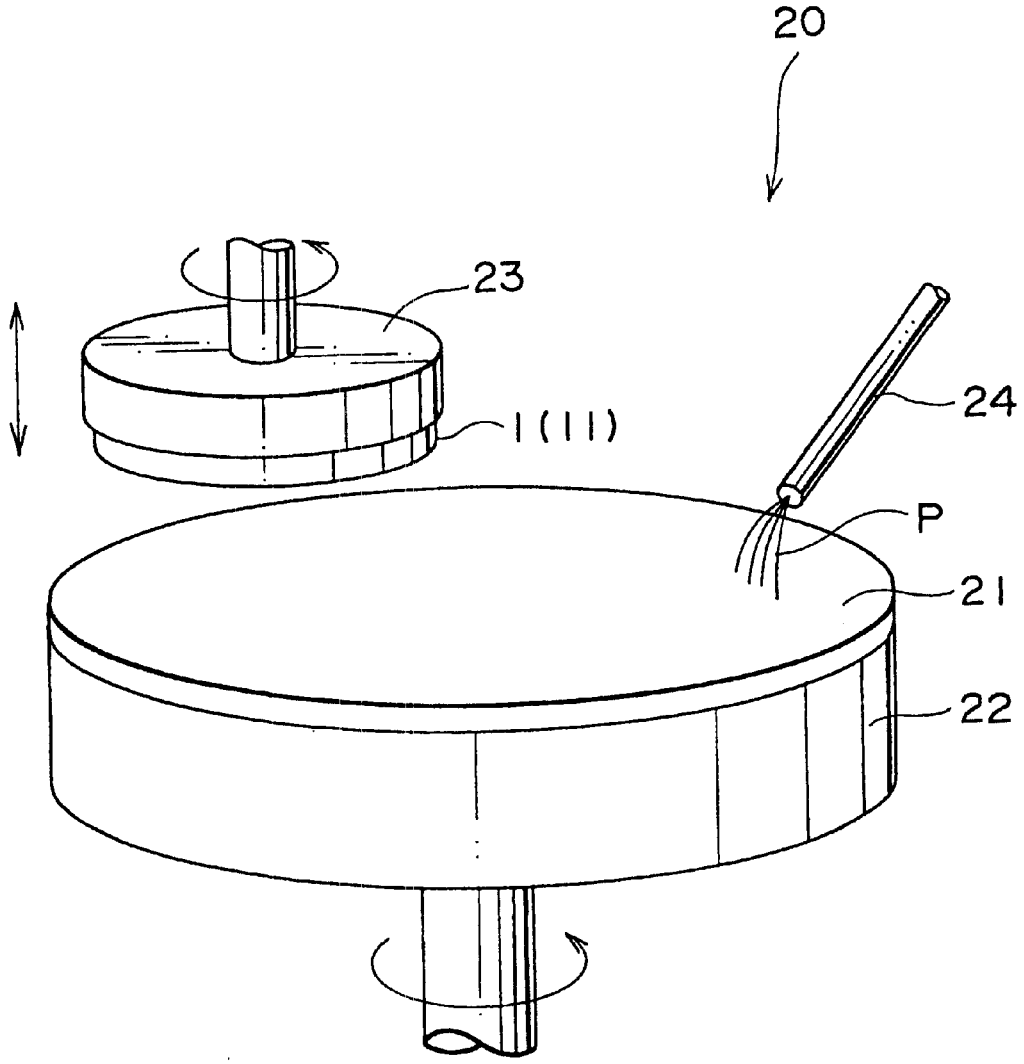
PRIOR ART F I G. 2
FIG. 2 is a perspective view schematically illustrating a planarizing and polishing apparatus of a related art.
Figure 3A:
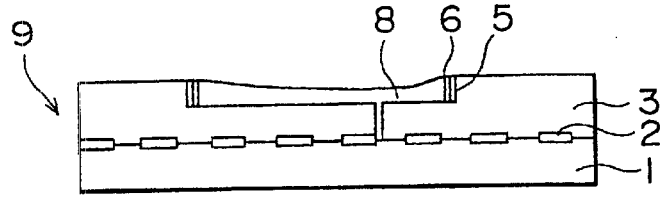
PRIOR ART FIG. 3A
FIGS. 3A to 3D are side elevation views of cross-sections illustrating a fault in the metal interconnection type substrate
Figure 3B:
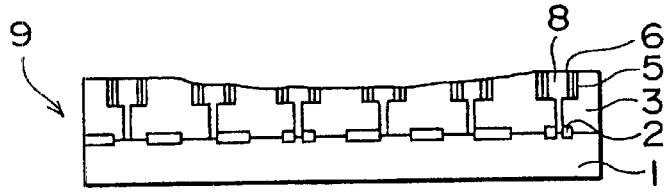
Figure 3C:
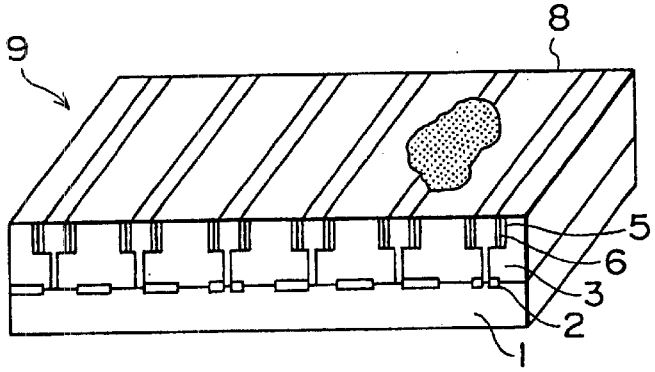
Figure 3D:
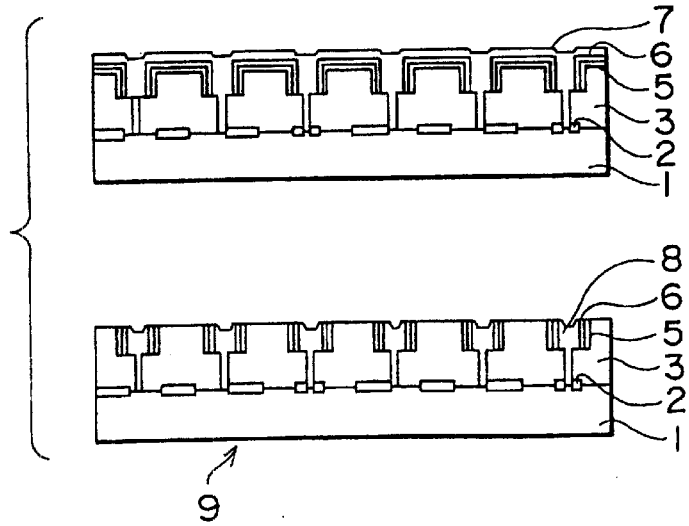
Figure 4:
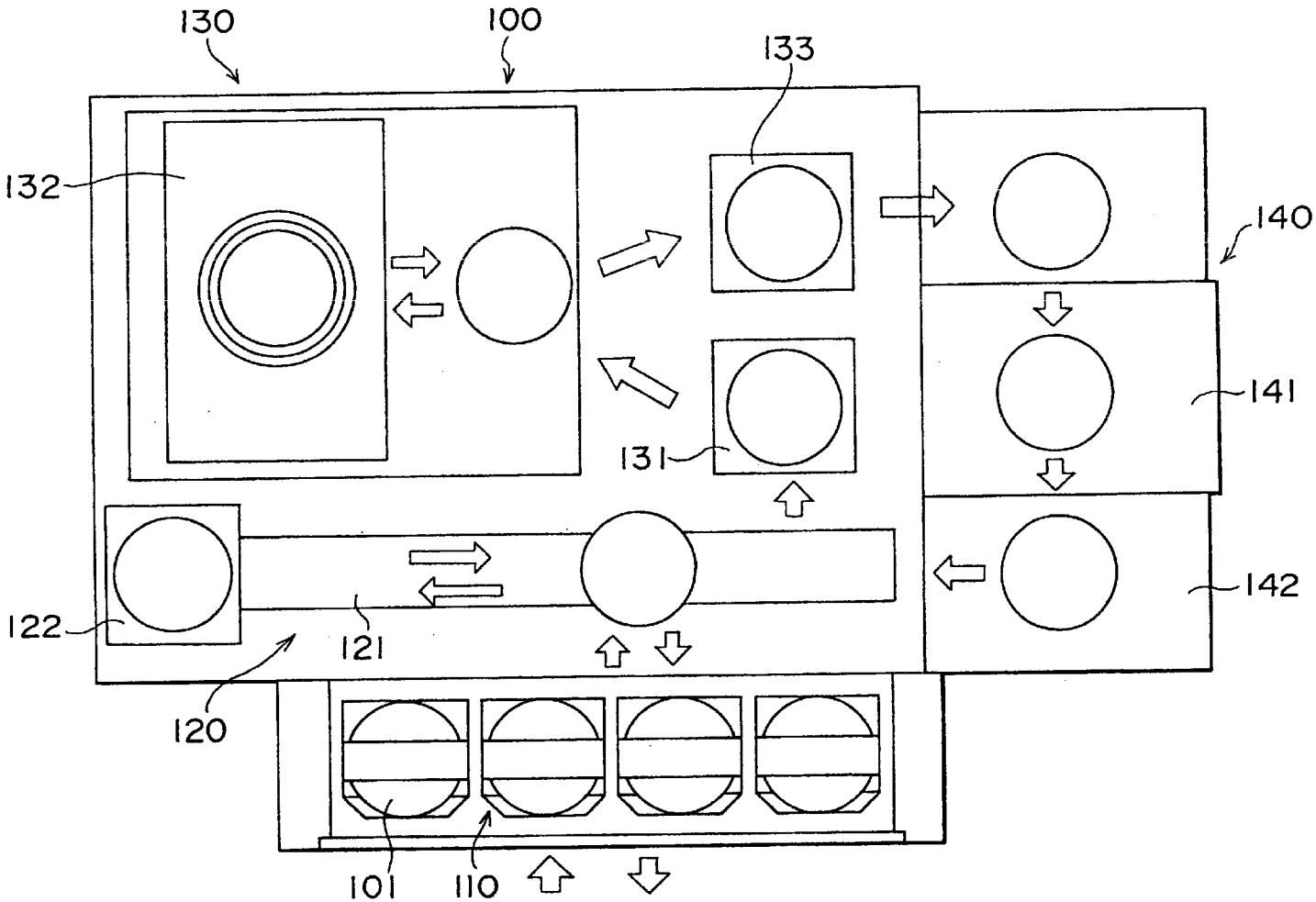
FIG. 4 is a plan view illustrating the entire configuration of an embodiment of the planarizing; and polishing apparatus of the present invention.

FIG. 4 is a plan view illustrating the entire configuration of the preferred embodiment of the planarizing and polishing apparatus of the present invention. The planarizing and polishing apparatus 100 of the present invention is roughly composed of a cassette port 110 to which wafers 101 as the polishing works are input, a handling system 120 for positioning the wafer 101 output from the cassette port 110, a polishing head 130 for chemically and mechanically polishing the wafer 101 positioned by the handling system 120 and a cleaner 140 for cleaning the wafer 101 which is chemically and mechanically polished by the polishing head 130. The wafer 101 is transferred among respective sections with a robot not illustrated in the figure. In such a configuration, the polishing process in the planarizing and polishing apparatus 100 will be explained. First, multiple wafers 101 are accommodated in parallel within the cassette 102 and this cassette 102 is then set to the cassette port 110. A sheet of wafers 101 is taken out from the cassette 102 and is then transferred to the handling system 120.

The wafer 101 transferred is then carried by a conveyor 121 to the positioning unit 122 for the purpose of centering and matching of orientation and is moreover carried again up to the initial position by the conveyor 121. The wafer 101 carried again is then transferred to the polishing head 130. The wafer 101 transferred is once input to a buffer 131 and thereafter set to the polishing unit 132. Thereby, the wafer is chemically and mechanically polished while the polishing condition is measured as will be explained later. The wafer 101 which has completed the polishing process is once taken out to a wet station 133 and is then transferred to the cleaner 140. The transferred wafer 101 is sent through a cleaning unit 141 for washing out chemicals and is then carried to a drying unit 142 for drying up the washing liquid. When the drying process is completed, the wafer 101 is then transferred again to the handling system 120 and is then accommodated in the vacant area of the cassette 102. When the processes explained above are completed for all wafers 101 accommodated, the cassette 102 is then taken out from the cassette port 110 and is then transferred to the next process.

Figure 5:
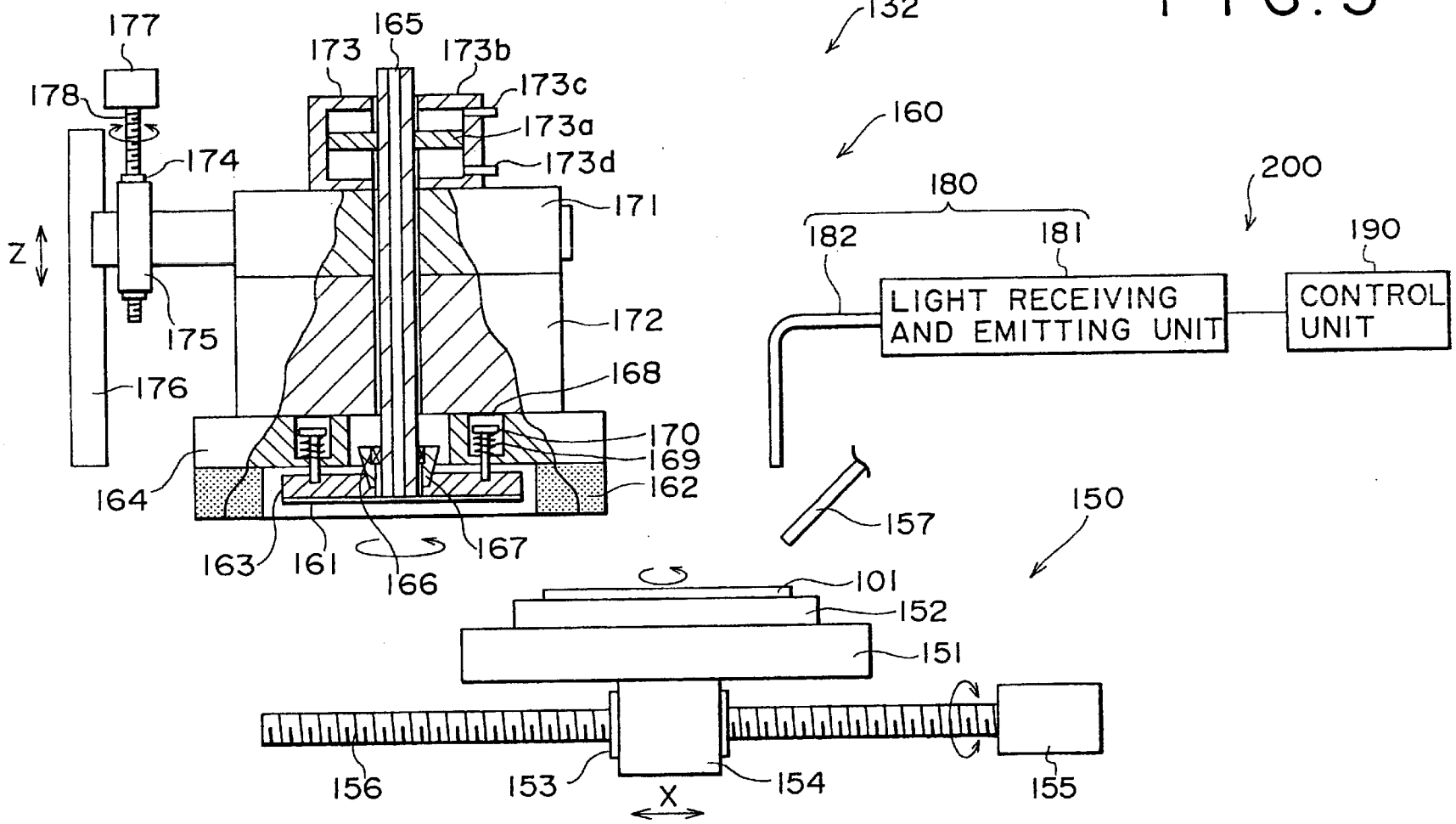
FIG. 5 is a partial side elevation view of cross-section illustrating details of the polishing unit of the planarizing and polishing apparatus of FIG. 4.

FIG. 5 is a partial side elevation view of cross-section illustrating details of the polishing unit 132 of the planarizing and polishing apparatus 100. This polishing unit 132 is roughly composed of a polishing table 150, a polishing head 160 and a polishing condition measuring unit 170. The polishing table 150 places and fixes the wafer 101 for rotation thereof and also moves the wafer 101 in the X direction. On the upper surface of the weighing table 151, a wafer chuck 152 is provided for vacuum-absorption of the wafer 101. At the lower surface of the weighing table 151, a support part 154 including an X-axis ball nut 153 is provided. This X-axis ball nut 153 is coupled with an X-axis servo motor 155 and is screwed with an X-axis ball screw 156 extended in the X direction. Moreover, a nozzle 157 is also provided to supply the polishing liquid at the area above the weighing table 151. Although not illustrated, the weighing table 151 comprises a mechanism for rotating the wafer chuck 152. The polishing head 160 moves in the Z direction to chemically and mechanically polish the wafer 101 fixed to the polishing table 150 in several stages. A disk type buff 161 in the same diameter as the wafer 101 and an annular type wheel 162 having the internal diameter which is larger than the diameter of this buff 161 are coaxially, namely concentrically provided. The buff 161 is bonded and fixed to the lower surface of the annular type metal surface plate 163, while the wheel 162 is bonded and fixed to the lower surface of an annular metal tool flange 1614. At the center hole of the metal surface plate 163, one end of a shaft 165 is fixed via a flange 167 including a bearing 166. This flange 167 is formed with the taper at its external circumference and is engaged and fixed with the internal circumference of the center hole of the metal surface plate 163 which is also formed as a tapered plate. In the upper surface side of the metal tool flange 164, spot facings 168 are provided with an equal angle interval. At the inside of this spot spacing 168, a pin 170*a* having a spring 169 is inserted in such a way as being projected toward the lower surface side of the metal tool flange 154. The end point of the pin 170 is engaged with the upper surface of the metal surface plate 163. At the upper surface of metal tool flange 164, a main shaft spindle 172 having a main shaft spindle motor 171 is fixed and moreover an air cylinder 173 is fixed to the upper part of the main shaft spindle motor 171. The shaft 165 is provided to be projected through the main shaft spindle 172, main shaft spindle motor 171 and the center of air cylinder 173 from the center hole of the metal tool flange 164. At the other end of the shaft 165, a piston 173*a* of the air cylinder 173 is fixed. The shaft 165 is formed in the hollow cylindrical shape to supply the polishing liquid. At the external circumference surface of the main shaft spindle motor 171, a support part 177 having the Z-axis ball nut 174 is provided. A support part 175 engaged with a Z-axis guide 176, a Z-axis ball nut 174 is coupled with a Z-axis servo motor 177 and is screwed with a Z-axis ball screw 178 extended in the Z direction. The polishing condition measuring unit 170 is composed of a detecting unit 180 and a control unit 190 which is electrically connected to this detecting unit 180. The detecting unit 180 detects a change in surface reflectivity of wafer 101 and is provided with a light receiving and emitting unit 181 and an optical fiber 182 connected to this light receiving and emitting unit 181. As the light receiving and emitting unit 181, a light emitting( diode (LED) for emitting an optical signal in the wavelength, for example, of 390 nm and a photosensor with an analog output including a photodetector are used to convert a drive signal input from the control unit 190 to an optical signal corresponding to the amplitude of drive signal and then send an optical signal to the optical fiber 182 and also convert the optical signal received from the optical fiber 182 to a sensor signal corresponding to the intensity of optical signal in order to output the sensor signal to the control unit 190. The optical fiber 182 is a double-core fiber. The fiber end is fixed facing to the surface of wafer 101 at the position adjacent to the polishing head 160 above the center line about 50 mm to 100 mm in the X direction of the wafer 101. The control unit 190 recognizes the additional polishing part of the wafer 161 based on the detected value from the detecting unit 180 and feeds back the polishing condition by automatically generating such condition of the additional polishing part and the portion other than the additional polishing part.

Figure 6:
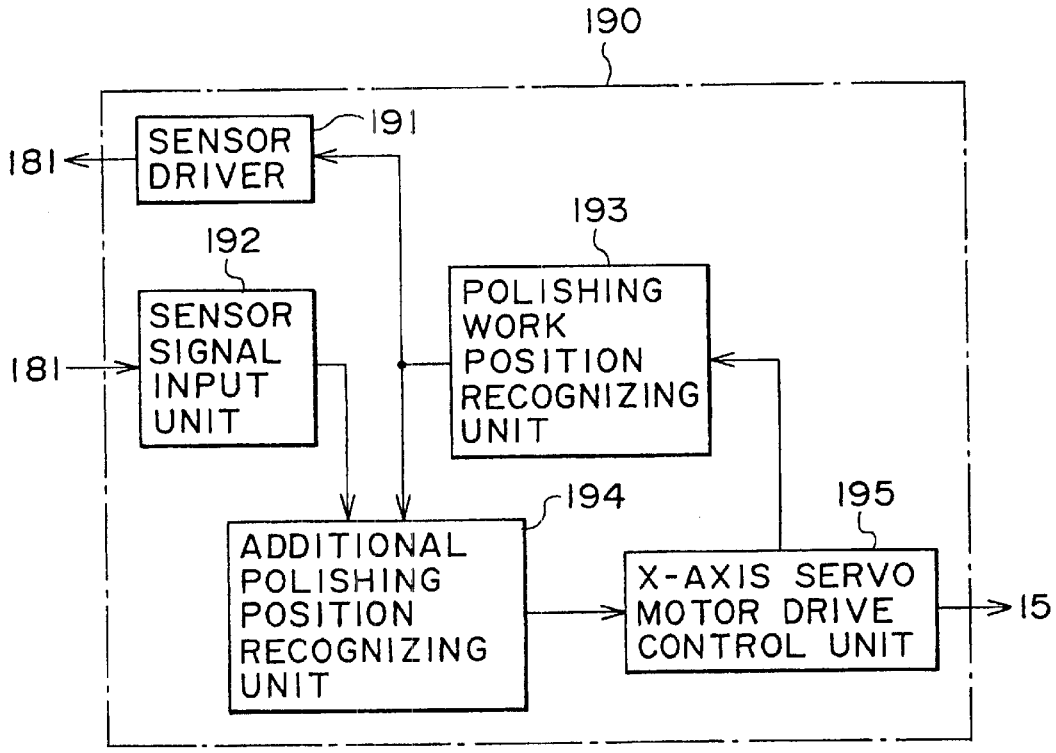
FIG. 6 is a block diagram illustrating details of a control unit in the polishing unit.

FIG. 6 is a block diagram illustrating detail of the configuration of the control unit 190. The control unit 190 is composed of a sensor drive unit 191, a sensor signal input unit 192, a polishing work position recognizing unit 193, an additional polishing position recognizing unit 194 and an X-axis servo motor drive control unit 195. The sensor drive unit 191 and sensor signal input unit 192 are electrically connected to the light receiving and emitting unit 181. The sensor drive unit 191 is electrically connected to the polishing work position recognizing unit 183. The sensor signal input unit 192 is electrically connected to the additional polishing position recognizing unit 194. The polishing work position recognizing unit 193, additional polishing position recognizing unit 194 and X-axis servo motor drive control unit 195 are loop-connected with each other. The X-axis servo motor drive control unit 195 is electrically connected to the X-axis servo motor 155. The sensor drive unit 191 of such configuration outputs the predetermined drive signal to the light receiving and emitting unit 181 depending on the position signal on the X axis of the wafer 101 from the polishing work position recognizing unit 193. The sensor signal input unit 192 receives the sensor signal from the light receiving and emitting unit 181 and then outputs this sensor signal to the additional polishing position recognizing unit 194. The polishing work position recognizing unit 193 recognizes the position on the X axis of the wafer 101 based on the drive signal from the X-axis servo motor drive control unit 195 and then outputs the position signal to the sensor drive unit 191 and additional polishing position recognizing unit 194. The additional polishing position recognizing unit 194 recognizes the position on the X axis of the additional polishing part on the wafer 101 based on the sensor signal from the sensor signal input unit 192 and the position signal on the X axis of wafer 101 from the polishing work position recognizing unit 193 and then outputs this position signal to the X-axis servo motor drive control unit 195. The X-axis servo motor drive control unit 195 controls drive of the X-axis servo motor 155 based on the position signal on the X axis of the additional polishing part of wafer 101 from the additional polishing position recognizing unit 194. Thereby, the wafer 101 fixed on the polishing table 150 can immediately be sent to the measuring process in the polishing condition measuring unit 170 after the polishing process by the polishing head 160 only with drive by the polishing table 150.

Figure 7:
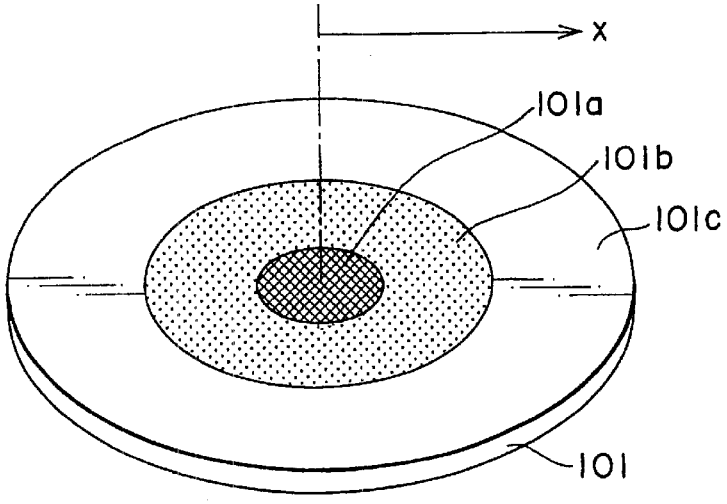
FIG. 7 is a perspective view illustrating an example of surface condition of a wafer after the polishing process.
Figure 8:
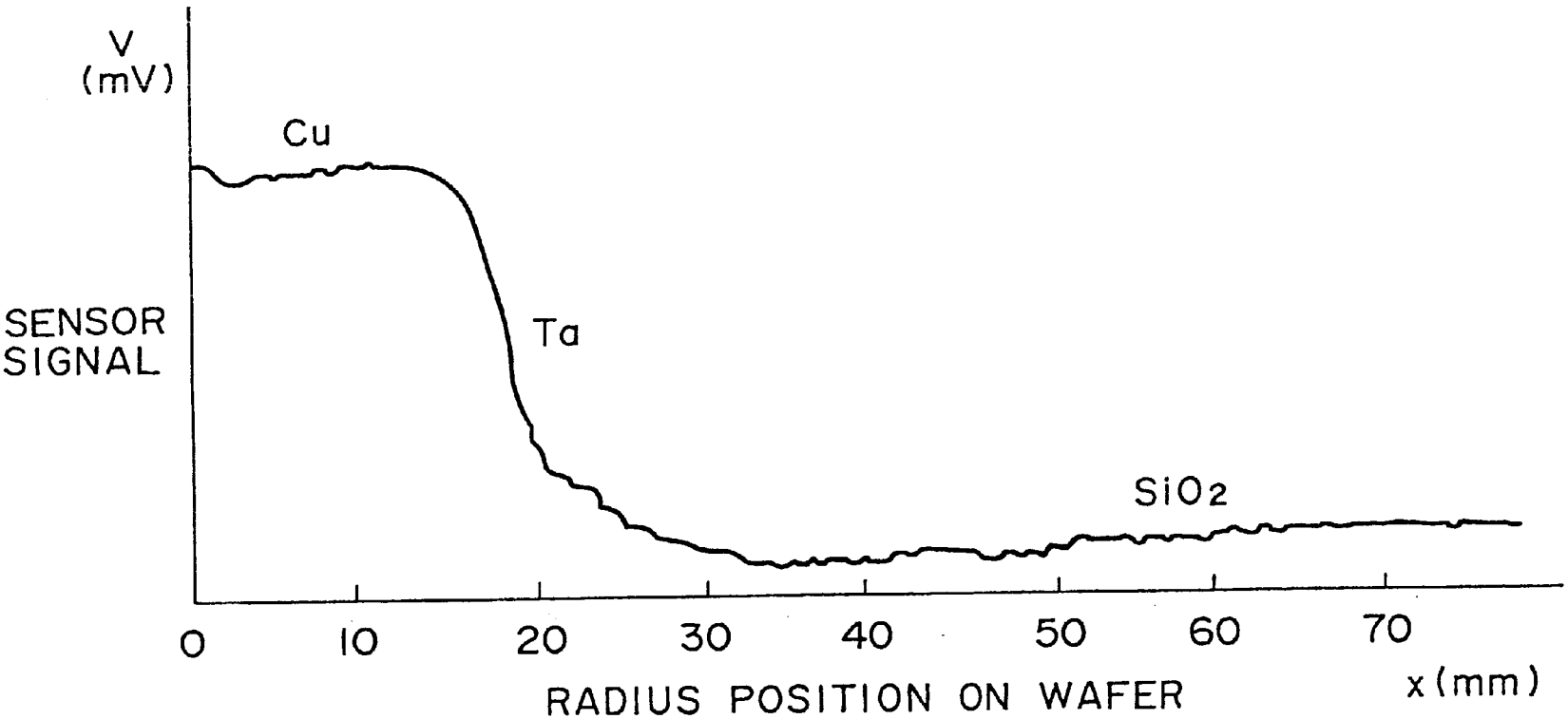
FIG. 8 is a diagram illustrating the surface reflectivity at the radius position of the wafer of FIG. 7.

First, relationship between the surface reflectivity of wafer 101 and the polishing condition of wafer 101 (additional polishing part and the other portion) will be explained. FIG. 7 is a perspective view illustrating an example of the surface condition of the wafer 101 after the polishing process. The wafer 101 is polished, while it is rotated by the polishing table Ad 150, by the rotating polishing head 160. Therefore, as illustrated in the figure, the additional polishing part 101*a* of the laminated interconnection pattern film 7 formed of copper (Cu), the additional polishing part 101*b* of barrier film 5 formed of tantalum (Ta) and the portion 101*c* other then the additional polishing part of the insulating film (oxide film) 3 formed of silicon dioxide (SiO2) are formed almost concentrically. Therefore, an average surface reflectivity corresponding to the position on the X axis of the wafer 101 can be obtained by measuring the surface reflectivity in the X direction toward the external circumference from the center of wafer 101 while the wafer 101 is rotated by the polishing table 150. Namely, as illustrated in FIG. 8, the surface reflectivity (indicated by a sensor signal V(mV) of the light receiving and emitting unit 181 in the figure) of wafer 101 measured when the wafer 101 in the condition when polished and washed by pure water, namely the wafer 101 in the wet condition is moved in the X direction while it is rotated at the rotating speed of 30 rpm, becomes maximum as high as about 60% to 80% at the circular area 101*a* ranged up to about x=18 mm from the center (x=0 mm) of the wafer 101, second maximum as high as about 20% to 40% at the ring area 101*b* ranged up to about x=28 mm from x=18 mm and becomes lowest as high as about 20% to 30% at the ring area 101*c* ranged up to about x=78 mm from x=28 mm. Judging from this figure, the polishing condition of wafer 101, namely position on the x axis of the part where the laminated interconnection pattern film 7 formed of copper (Cu) and the barrier film 5 formed of tantalum (Ta) are still left and the polished part where the insulating film (oxide film) 3 formed of silicon dioxide (SiO2) is exposed can be recognized.

Next, generation of polishing conditions for the additional polishing part and the portion other than the additional polishing part of the wafer 101 will then be explained. Upon recognition of the position on the X axis of the polishing condition of wafer 101, the feed rate pattern in the X direction of the polishing table 150, namely the feed rate Fx (mm/min) of radius position x (mm) of the wafer 101 is read from the tentative recipe as the polishing conditions in the past or the recipe as the polishing condition of the preceding polishing process and over-riding compensation is performed based on the result of above recognition. In this over-riding compensation, a degree of over-polishing or under-polishing is multiplied with the feed rate Fx (mm/min) of the radius position x (mm) of the wafer 101 for the purpose of compensation. For example, when a degree of under-polishing is defined as 50%, the compensated feed rate F'x (mm/min) becomes equal to 0.5 times of the initial feed rate Fx (mm/min). Therefore, the passing time at the radius position x (mm) of wafer 101 is doubled and a degree of polishing is also doubled. On the contrary, when a degree of over-polishing is defined as 200%, the compensated feed rate F'x (mm/min) becomes equal to two times the initial feed rate Fx (mm/min). Therefore, the passing time at the radius position x (mm) of wafer 101 becomes 0.5 times and a degree of polishing also becomes 0.5 times. In above case, when the recording density of chip as a whole is set to 50%, the over-riding is compensated under the conditions that the over-riding is assumed to 50% (a degree of polishing is two times) for the part where reflectivity is 50% or more (corresponding to the part of the laminated interconnection pattern film 7 formed of copper (Cu)), or to 80% (a degree of polishing is 1.2 times) for the part where reflectivity is 40% to 60% (corresponding to the part where the laminated interconnection pattern film 7 formed of copper (Cu) and the barrier film 5 formed of tantalum (Ta) are mixed) or to 200% (a degree of polishing is 0.5 times) for the part where reflectivity is 40% or less (corresponding to the part where the barrier film 5 formed of tantalum (Ta) and the insulating film (oxide film) 3 formed of silicon dioxide ($SiO_2$) are mixed).

Figure 9:
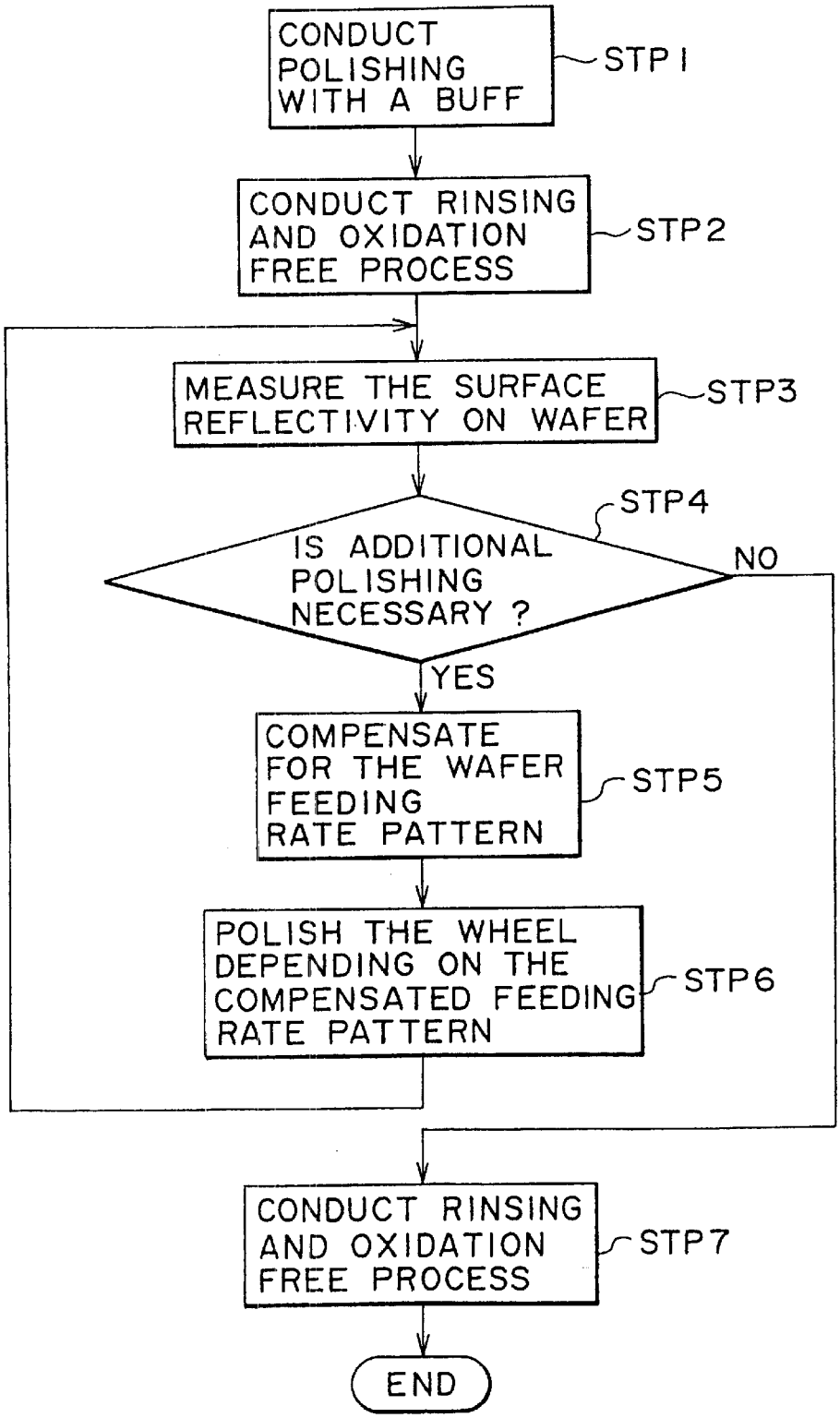
FIG. 9 is a flowchart illustrating an operating example of the planarizing and polishing apparatus of FIG. 4.
Figure 10:
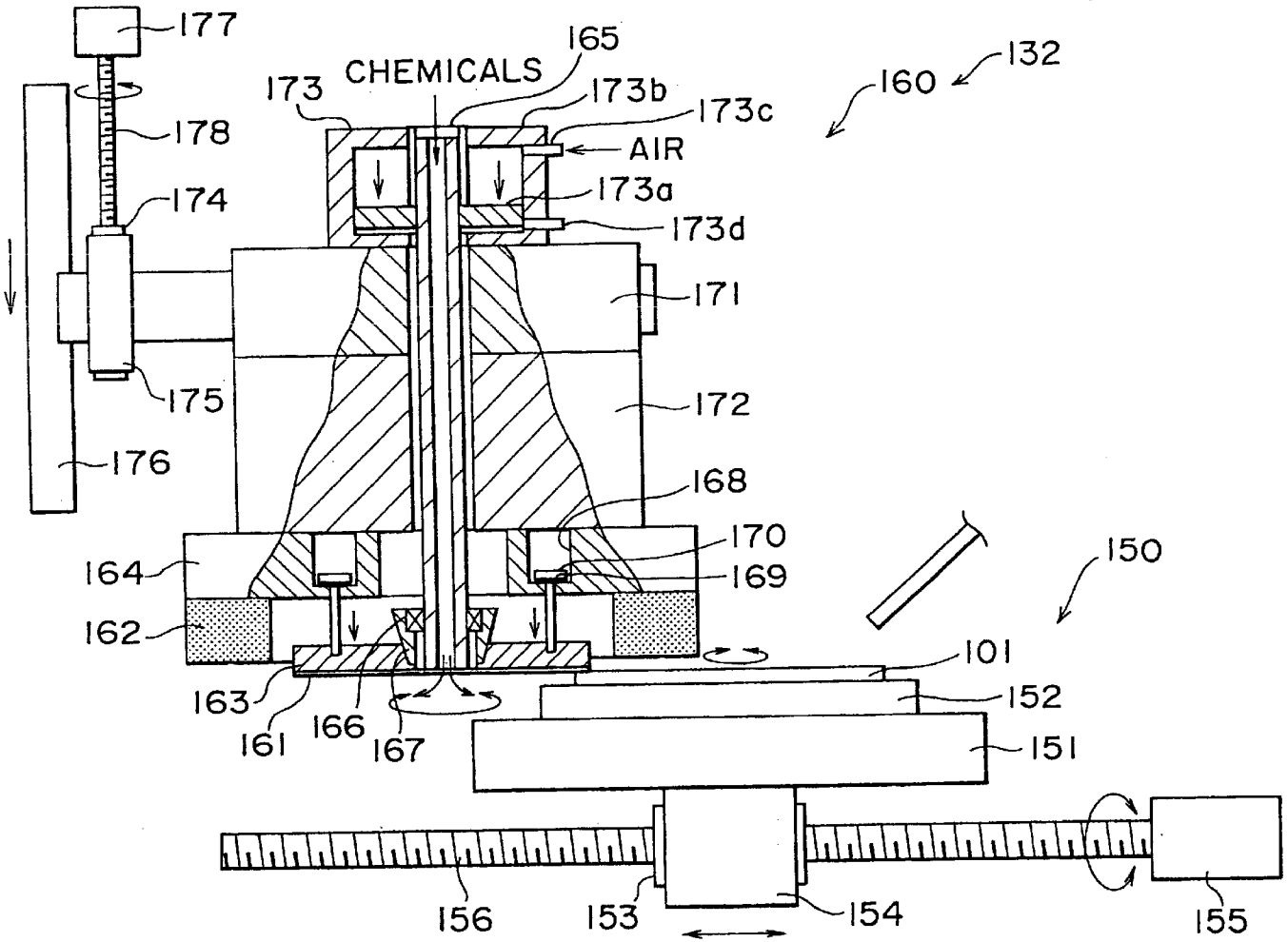
FIG. 10 is a first side elevation view of cross-section illustrating operation example of the planarizing and polishing apparatus of FIG. 4.
Figure 11:
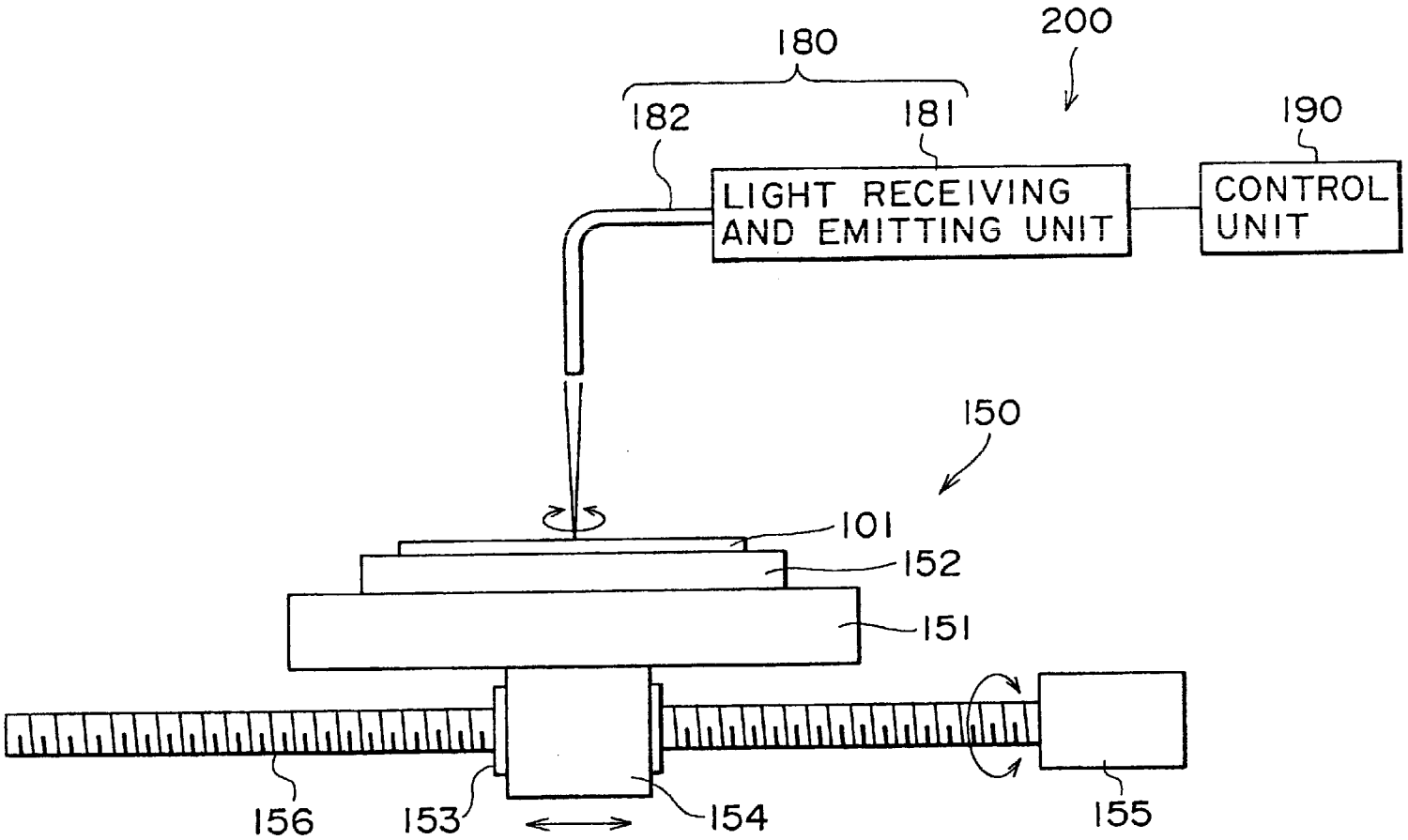
FIG. 11 is a second side elevation view of cross-section illustrating operation example of the planarizing and polishing apparatus of FIG. 4.
Figure 12:
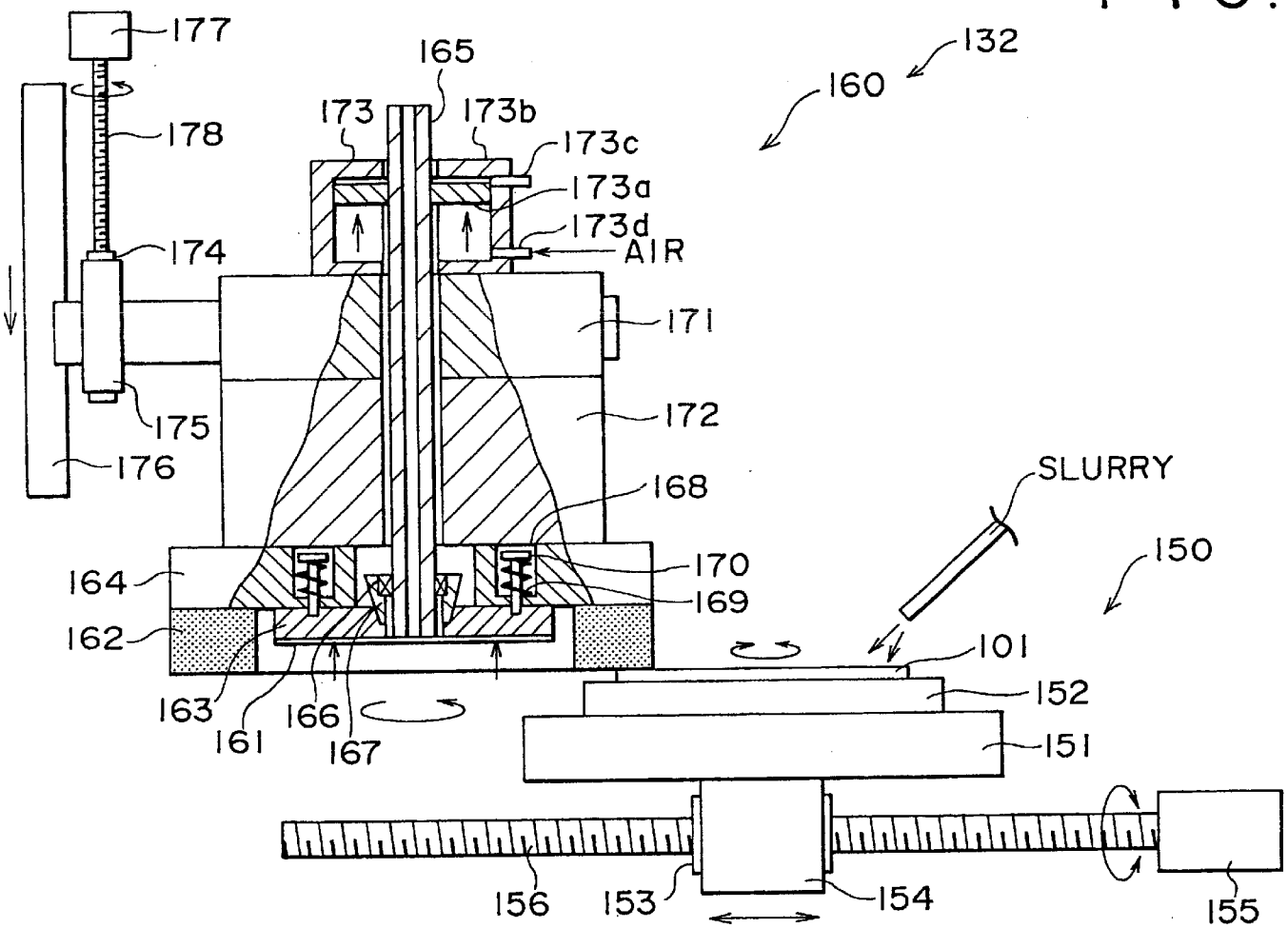
FIG. 12 is a third side elevation view of cross-section illustrating operation example of the planarizing and polishing apparatus of FIG. 4.

Operation examples in the configuration explained above will be explained with reference to the flowchart of FIG. 9 and operation diagrams of FIG. 10 to FIG. 12. Here, as the buff 161, a soft buff, for example, is used and as the polishing liquid, a chemical of etchant such ads nitric acid ($HNO_3$), for example, is used. Meanwhile, as the wheel 162, a hard wheel in which hard alumina grain ($\gamma$-$A_{12}Y_3$, grain size=0.35 $\mu$m, specific gravity=1.61) is fixed and as the polishing liquid for this wheel, a slurry (ph 4.8), which is obtained by dispersing alumina grain of 10 wt % ($Al_2O_2$, grain size=0.16 $\mu$m, Mohs' hardness 8.0) to the 3% hydrogen peroxide ($H_2O_2$), is used. According to the polishing process by this wheel 162 and slurry, the polishing rate of copper (Cu), tantalum (Ta) and silicon dioxide ($SiO_2$) becomes 1200 Å/min, 130, 60 Å/min or less, respectively. The polishing is first conducted using the buff 161 (refer to FIG. 10), thereafter measurement is performed using the polishing condition measuring unit 170 (refer to FIG. 11) and the polishing using the wheel 162 is then performed based on the result of such measurement (refer to FIG. 12). When the wafer 101 is vacuum-adsorbed by the chuck 152, the X-axis servo motor 155 is driven to rotate the X-axis ball screw 156 and the weighing table 151 is moved via the support part 154 until the wafer 101 is located to the predetermined polishing start position. The rotating mechanism built in the weighing table 151 is driven to rotate the wafer 101 via the wafer chuck 152. Simultaneously, the main shaft spindle motor 171 is driven to rotate the wheel 162 via the main shaft spindle 172 and in addition to rotate the buff 161 via the pin 170. Next, the Z-axis servo motor 177 is driven to rotate the Z axis ball screw 178 and the support part 175 is moved downward along the Z-axis guide 176 until the polishing surface of the wheel 162 is located providing the predetermined interval from the surface of the wafer 101 being vacuum-adsorbed to the wafer chuck 152. Here, the chemical liquid is supplied to the buff 161 via the hollow part of shaft 165 arid groove 163*a* of the metal surface plate 163 from the chemical liquid supplying unit not illustrated. Simultaneously, the air is supplied to a pressurizing side supply port 173*c*, provided to the cylinder 173*b* of the air cylinder 173 to move downward the metal surface plate 163 via a piston 173*a* and shaft 165. In this timing, the metal surface plate 163 compresses a spring 169 and the polishing surface of buff 161 is projected from the polishing surface of the wheel 162. The polishing surface of buff 161 is pushed to the surface of wafer 101, the X-axis servo motor 155 is driven to rotate the X-axis ball screw 156 and to cause the weighing table 151 to make reciprocal movement via the support part 154 in view of chemically and mechanically polishing the wafer 101. The absolute value of a degree of polishing in this case can be mainly controlled depending on the pressure of the air cylinder 173 and passing speed of the buff 161 against the wafer 101 (STP1). Upon completion of the polishing, supply of chemical liquid is stopped, the pure water and chemical liquid are supplied to the surface of wafer 101 via the nozzle not illustrated, and the polishing liquid and particles being left at the surface of wafer 101 are removed by the washing for the purpose of rinsing and prevention of oxidation (STEP2). Subsequently, the air is supplied to the withdrawing side supply port 173*d* provided to the cylinder 173*b* of the air cylinder 173 to move upward the metal surface plate 163 via the piston 173*a* and shaft 165, thereby separating the polishing surface of buff 161 from the surface of wafer 101. In this timing, the upper surface of the metal surface plate 163 is pushed to the lower surface of the metal tool flange 164 with a recovery force of the spring 169 and the polishing surface of buff 161 is withdrawn from the polishing surface of the wheel 162. In view of measuring the polishing condition of the wafer 101, the X-axis servo motor 155 is driven to rotate the X-axis ball screw 156 and to move the weighing table 151 via the support part 154 until the center (x=0 mm) of the wafer 101 is located just under the optical fiber 182. Upon completion of this positioning, the surface of wafer 101 is radiated with the light beam emitted from the light receiving and emitting unit 181 via the optical fiber 182, the reflected light beam from the wafer surface is then received by the light receiving and emitting unit 181 via the optical fiber 182. Thereby, the surface reflectivity of wafer 101 is detected. Simultaneously, the X-axis servo motor 155 is driven to rotate the X-axis ball screw 156 and to move the weighing table 151 as mulch as the radius of the wafer 101 via the support part 154. Thereby, the surface reflectivity of wafer 101 is measured in relation to the position on the X axis of the wafer 101 and the feed rate pattern of wafer 101 by the X axis servo motor 155 is compensated on the basis of the measuring result (STP3 to 5). Next, the X-axis servo motor 155 is driven to rotate the X-axis ball screw 156 and to move the weighing table 151 via the support part 154 until the wafer 101 is located to the predetermined polishing start position. Here, the slurry is supplied to the surface of wafer 101 via the nozzle 157 from the supplying apparatus not illustrated. Simultaneously, the Z-axis servo motor 177 is driven in the direction inverted from that in the preceding drive to rotate the Z-axis ball screw 178 and to move the support part 175 downward along the Z-axis guide 176. The polishing surface of wheel 162 is pushed to the surface of wafer 101, the X-axis servo motor 155 is driven, based on the compensated feed rate pattern explained above, to rotate the X-axis ball screw 156, to move reciprocally the weighing table 151 via the support part 154 and to polish chemically and mechanically the wafer 101 (STP6). After completion of this polishing, supply of slurry is stopped, the pure water is supplied to the surface of wafer 101 via the nozzle not illustrated to wash the slurry and particles remaining on the surface of wafer 101. Thereafter, returning to the step STP3, the polishing condition of wafer 101 is measured again. When the part to be polished further (additional polishing part) exists on the wafer 101 (STP4), re-polishing is conducted in the step STP5. Meanwhile, when the additional polishing part is not detected on the wafer 101 (STP4), the pure water and chemical liquid are supplied to the surface of wafer 101 via the nozzle not illustrated to wash the slurry and particle remaining on the surface of wafer 101 for the purpose of rinsing and prevention of oxidation (STP7). Thereby, every polishing process is completed.

As explained above, since the polishing process is conducted while measuring the polishing condition of the wafer 101, under-polishing is never generated for the entire surface of wafer 101, the polishing process with less over-polishing can be realized and polishing accuracy and polishing stability can be much improved, in comparison with the case in the related art where the polishing process is performed only based on the time management. Moreover, since the polishing process is established in the related art considering in-processing fluctuation, unwanted margin is preset, resulting in the drawbacks that severe specifications are required for preceding and subsequent processes and sufficient device characteristics cannot be attained. However, according to the preferred embodiment of the present invention explained above, various merits such as expansion of process margin, improvement in the processing margin and realization of cost-down can be attained. In addition, the polishing conditions have often been detected in the related art depending on experience and intuition of operator and the procedures for detecting polishing conditions have also been troublesome. However, according to the preferred embodiment of the present invention, such polishing conditions can be detected automatically and therefore particular skill is never required for maintenance work.

As explained above, the present invention enables measurement of the polishing condition of a polishing work during the polishing process and thereby realizes acquisition of a fault-free polishing work.

What is claimed is:

1. A planarizing and polishing apparatus including a polishing unit for polishing flat a polishing surface of a polishing work by relatively moving the polishing work only in one direction, comprising:

a detecting unit for detecting a change in polishing surface reflectivity of said polishing work to provide a detected value representative thereof while polishing is occurring; and a control unit for recognizing, based on the detected value from said detecting unit, an additional polishing part of said polishing work and then automatically generating, for a polishing feedback control purpose, polishing conditions of said additional polishing part of the polishing work and a portion other than the additional polishing part.

2. A planarizing and polishing apparatus as claimed in claim 1, wherein said detecting unit is provided with a light receiving and emitting unit for receiving and emitting a light beam and an optical fiber connected to said light receiving and emitting unit.

3. A planarizing and polishing apparatus as claimed in claim 1, wherein said control unit recognizes the part of said polishing surface of said polishing work in which said detected value is equal to or larger than the predetermined value as said additional polishing part.

4. A planarizing and polishing apparatus as claimed in claim 1, wherein the polishing condition is generated so that said polishing unit is relatively moved at a higher speed for the portion other than said additional polishing part and is also relatively moved at a lower speed for said additional polishing part.

5. A planarizing and polishing method for polishing flat a polishing surface of said polishing work by relatively moving the polishing unit at the polishing surface of polishing work only in one direction, comprising the steps of:

polishing the polishing surface of said polishing work;

detecting a change in polishing surface reflectivity of said polishing work;

recognizing a part of said polishing surface where said detected value is equal to or larger than the predetermined value as the additional polishing part of said polishing work; and conducting a polishing process again to the polishing surface of said polishing work by relatively moving said polishing unit at a higher speed for the portion other than said additional polishing part and by relatively moving said polishing unit at a lower speed for said additional polishing part.

6. The method as set forth in claim 5 wherein the step of detecting a change in polishing surface reflectivity is followed by a step of determining whether additional polishing is necessary whereupon if no, is followed by a step of rinsing and ending polishing, and if yes, followed by a step of compensating for the wafer feeding rate pattern and polishing depending on said compensated feeding rate pattern.

7. The method as set forth in claim 5 wherein the step of conducting a polishing process is carried out wherein the additional polishing part is located near a center of said wafer, while said portion other than said additional polishing part is located remotely from or contiguous with said additional polishing part.

8. The apparatus as set forth in claim 1, wherein said detecting unit includes a polishing work recognizing unit, a sensor drive unit, and a light receiving and emitting unit detecting polishing surface reflectivity of said polishing work in said one direction toward an external position remote from a center of said polishing work.

9. The apparatus as set forth in claim 1, wherein said control unit generates polishing conditions that include over-riding compensation when over-polishing and under-polishing to compensate for a polishing work feeding rate pattern.

10. A planarizing and polishing apparatus including a polishing unit for polishing flat a polishing surface of a polishing work by relatively moving the polishing work only in one directions, comprising:

detecting means for detecting a change in polishing surface reflectivity of said polishing work and providing a detected value representative thereof; and control means for recognizing, responsive to the detected value from said detecting means, an additional polishing part of said polishing work and generating, for polishing control, polishing conditions of said additional polishing part o f the polishing work and a portion other than the additional polishing part.

11. The planarizing and polishing apparatus as claimed in claim 9, wherein said detecting means includes light receiving and emitting means for determining surface reflectivity.

* * * * *

UNITED STATES PATENT AND TRADEMARK OFFICE

CERTIFICATE OF CORRECTION

PATENT NO. : 6,461,222 B1
DATED : October 8, 2002
INVENTOR(S) : Shuzo Sato

It is certified that error appears in the above-identified patent and that said Letters Patent is hereby corrected as shown below:

Column 10,
Line 49, “directions” should read -- direction --.
Line 58, “o f” should read -- of --.

Signed and Sealed this

Twenty-second Day of July, 2003

JAMES E. ROGAN
*Director of the United States Patent and Trademark Office*